US011802563B2

(12) United States Patent
Kanda et al.

(10) Patent No.: US 11,802,563 B2
(45) Date of Patent: Oct. 31, 2023

(54) SCREW COMPRESSOR

(71) Applicant: Mitsubishi Electric Corporation, Tokyo (JP)

(72) Inventors: Masahiro Kanda, Tokyo (JP); Shun Okada, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 17/761,299

(22) PCT Filed: Nov. 26, 2019

(86) PCT No.: PCT/JP2019/046099

§ 371 (c)(1),
(2) Date: Mar. 17, 2022

(87) PCT Pub. No.: WO2021/106061

PCT Pub. Date: Jun. 3, 2021

(65) Prior Publication Data

US 2022/0349404 A1 Nov. 3, 2022

(51) Int. Cl.
*F03C 2/00* (2006.01)
*F03C 4/00* (2006.01)
(Continued)

(52) U.S. Cl.
CPC ..... *F04C 28/24* (2013.01); *F04C 18/165* (2013.01); *F04C 18/50* (2013.01); *F04C 2270/58* (2013.01)

(58) Field of Classification Search
CPC ..... F04C 18/16; F04C 18/165; F04C 18/50; F04C 18/52; F04C 18/54; F04C 28/12; F04C 28/24; F04C 2270/58
See application file for complete search history.

(56) References Cited

U.S. PATENT DOCUMENTS 4,747,755 A * 5/1988 Ohtsuki ..... F04C 28/125 418/195
2006/0039805 A1* 2/2006 Gotou ..... F04C 28/12 417/410.4

(Continued)

FOREIGN PATENT DOCUMENTS

EP 3981987 A1 * 4/2022 ..... F04C 18/52
JP H01-134791 A 5/1989

(Continued)

OTHER PUBLICATIONS

TW201627577A—Ito et al.—Screw Compressor—Aug. 1, 2016—the English Machine Translation (Year: 2016).*

(Continued)

*Primary Examiner* — Theresa Trieu
(74) *Attorney, Agent, or Firm* — POSZ LAW GROUP, PLC

(57) ABSTRACT

A screw compressor has a slide valve movement mechanism that includes a cylinder provided in a casing body, a piston partitioning an interior of the cylinder into a first chamber and a second chamber, and a communication flow passage through which the second chamber communicates with a low-pressure space. The cylinder includes a first inflow hole, a second inflow hole, and a third inflow hole. The first chamber communicates with a high-pressure space through the first inflow hole, the second chamber communicates with the low-pressure space through the second inflow hole and the communication flow passage, and the second chamber communicates with the high-pressure space through the third inflow hole. The third inflow hole is located at a position at which the third inflow hole is closed by the piston when the piston lies at a stop position at which the piston moves toward the second chamber and stops.

4 Claims, 5 Drawing Sheets

(51) Int. Cl.

| | |
|---|---|
| ***F04C 18/00*** | (2006.01) |
| ***F04C 2/00*** | (2006.01) |
| ***F04C 28/24*** | (2006.01) |
| ***F04C 18/16*** | (2006.01) |
| ***F04C 18/50*** | (2006.01) |

(56) References Cited

U.S. PATENT DOCUMENTS

| | | | | |
|---|---|---|---|---|
| 2012/0003113 | A1* | 1/2012 | Shikano | F04C 18/52 418/195 |
| 2013/0011291 | A1* | 1/2013 | Hossain | F04C 18/50 418/195 |

FOREIGN PATENT DOCUMENTS

| | | | | | |
|---|---|---|---|---|---|
| JP | 2010-255595 | A | | 11/2010 | |
| JP | 2013-036403 | A | | 2/2013 | |
| JP | 2016017465 | A | * | 2/2016 | F04C 28/12 |
| TW | 201627577 | A | * | 8/2016 | F04C 18/52 |

OTHER PUBLICATIONS

International Search Report dated Feb. 10, 2020, issued in corresponding International Patent Application No. PCT/JP2019/046099 (and English Machine Translation).

* cited by examiner

SCREW COMPRESSOR

CROSS REFERENCE TO RELATED APPLICATION

This application is a U.S. National Stage Application of International Application No. PCT/JP2019/046099, filed on Nov. 26, 2019, the contents of which are incorporated herein by reference.

TECHNICAL FIELD

The present disclosure relates to a screw compressor to be used to compress refrigerant in, for example, a refrigerating machine.

BACKGROUND ART

In a case where a screw compressor has a fixed internal volume ratio that is a ratio between a suction volume and a discharge volume, compression loss may increase because of excessive compression or insufficient compression depending on the operating condition. As a solution to this problem, a screw compressor has been known that has a slide valve that allows for a variable internal volume ratio (see, for example, Patent Literature 1). In this screw compressor, the slide valve is moved in the shaft direction of a screw rotor to change the position at which high-pressure refrigerant gas in a compression chamber formed in spiral grooves of the screw rotor starts to be discharged to thereby vary the discharge volume. Consequently, the internal volume ratio is regulated.

In Patent Literature 1, as a structure to move the slide valve, a piston connected with the slide valve is located in a cylinder, as illustrated in FIG. 3 of Patent Literature 1. In this structure, the interior of the cylinder is partitioned by the piston into a first chamber and a second chamber. The piston is moved because of the pressure difference between the first chamber and the second chamber, and accordingly the slide valve is moved. In each of the first chamber and the second chamber, a small-diameter inflow hole (not illustrated) is provided through which high-pressure refrigerant gas flows into the corresponding one of the first chamber and the second chamber. A communication flow passage is connected to the second chamber. Refrigerant gas in the second chamber flows out toward the low-pressure space through the communication flow passage. A valve provided in the communication passage is opened and closed to control the pressure in the second chamber such that the pressure in the second chamber is at a high level or a low level to move the piston and thereby move the slide valve.

CITATION LIST

Patent Literature

Patent Literature 1: Japanese Unexamined Patent Application Publication No. 2013-36403

SUMMARY OF INVENTION

Technical Problem

In Patent Literature 1, when the slide valve is moved toward one side in the shaft direction of the screw rotor, the valve provided in the communication flow passage needs to be opened to cause the second chamber to communicate with the low-pressure space to decrease the pressure in the second chamber. While the pressure in the second chamber is decreased in the manner as described above, high-pressure refrigerant gas constantly flows into the second chamber through the inflow hole. The high-pressure refrigerant gas having flowed into the second chamber constantly flows out toward the low-pressure space during the period during which the valve is opened. There is thus a problem in that a reduction in the flow rate of refrigerant gas to be sucked into and circulate through a compressor and other factors result in performance degradation.

The present disclosure has been achieved to solve the above problem, and an object of the present disclosure is to provide a screw compressor that achieves reduced leakage of refrigerant gas from an inflow hole through which high-pressure refrigerant gas flows into a second chamber.

Solution to Problem

A screw compressor according to an embodiment of the present disclosure has a casing body that has, inside the casing body, a high-pressure space and a low-pressure space; a screw rotor that has a plurality of grooves that are each shaped in a spiral and are formed at an outer circumferential surface of the screw rotor, the screw rotor being rotationally driven; gate rotors, each of which has a plurality of gate-rotor tooth portions to mesh with the plurality of grooves of the screw rotor, the gate rotors defining a compression chamber together with the casing body and the screw rotor; a slide valve accommodated in a slide groove formed in an inner wall surface of the casing body, the slide valve being configured to move such that the slide valve slides in a rotational-shaft direction of the screw rotor; and a slide valve movement mechanism configured to move the slide valve such that the slide valve slides in the rotational-shaft direction of the screw rotor. The slide valve movement mechanism has a cylinder provided in the casing body, the cylinder being hollow, a piston connected with the slide valve, the piston partitioning an interior of the cylinder into a first chamber and a second chamber, a communication flow passage through which the second chamber communicates with the low-pressure space, and a valve configured to open and close the communication flow passage. The slide valve movement mechanism is configured to vary a pressure in the second chamber by opening and closing the valve and thus move the piston and the slide valve. The cylinder is provided with a first inflow hole, a second inflow hole, and a third inflow hole, the first chamber communicating with the high-pressure space through the first inflow hole, the second chamber communicating with the low-pressure space through the second inflow hole and the communication flow passage, the second chamber communicating with the high-pressure space through the third inflow hole. The third inflow hole is located at a position at which the third inflow hole is closed by the piston when the piston lies at a stop position at which the piston moves toward the second chamber and stops.

Advantageous Effects of Invention

According to an embodiment of the present disclosure, the third inflow hole is closed by the piston when the piston lies at a stop position at which the piston moves toward the second chamber and stops. This stops high-pressure refrigerant gas from flowing into the second chamber through the third inflow hole, and consequently achieves reduced leakage of refrigerant gas from the second chamber toward the low-pressure space.

DESCRIPTION OF EMBODIMENTS

Figure 1:
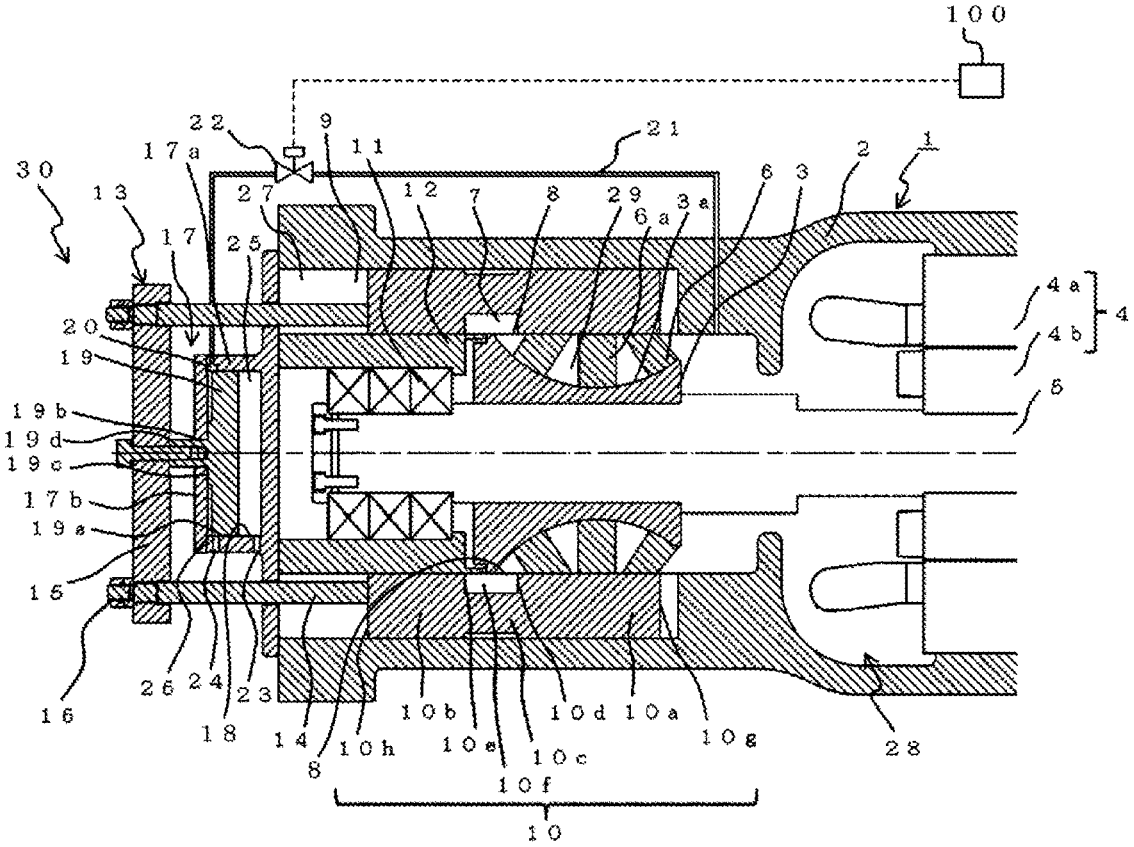
FIG. 1 is a schematic cross-sectional view of a slide valve movement mechanism in a screw compressor according to Embodiment 1 when a piston is moved toward a second chamber.

A screw compressor according to an embodiment of the present disclosure will be described hereinafter with reference to the drawings. In the drawings below including FIG. 1, the same reference signs denote the same or corresponding components, and are common throughout the entire descriptions of the embodiments described below. The forms of the components represented throughout the entire specification are merely examples, and do not intend to limit the components to the forms described in the specification. Further, the level of the pressure is not particularly determined in relation to an absolute value, but is determined relatively by the condition, operation, and other state of the screw compressor.

Embodiment 1

Figure 2:
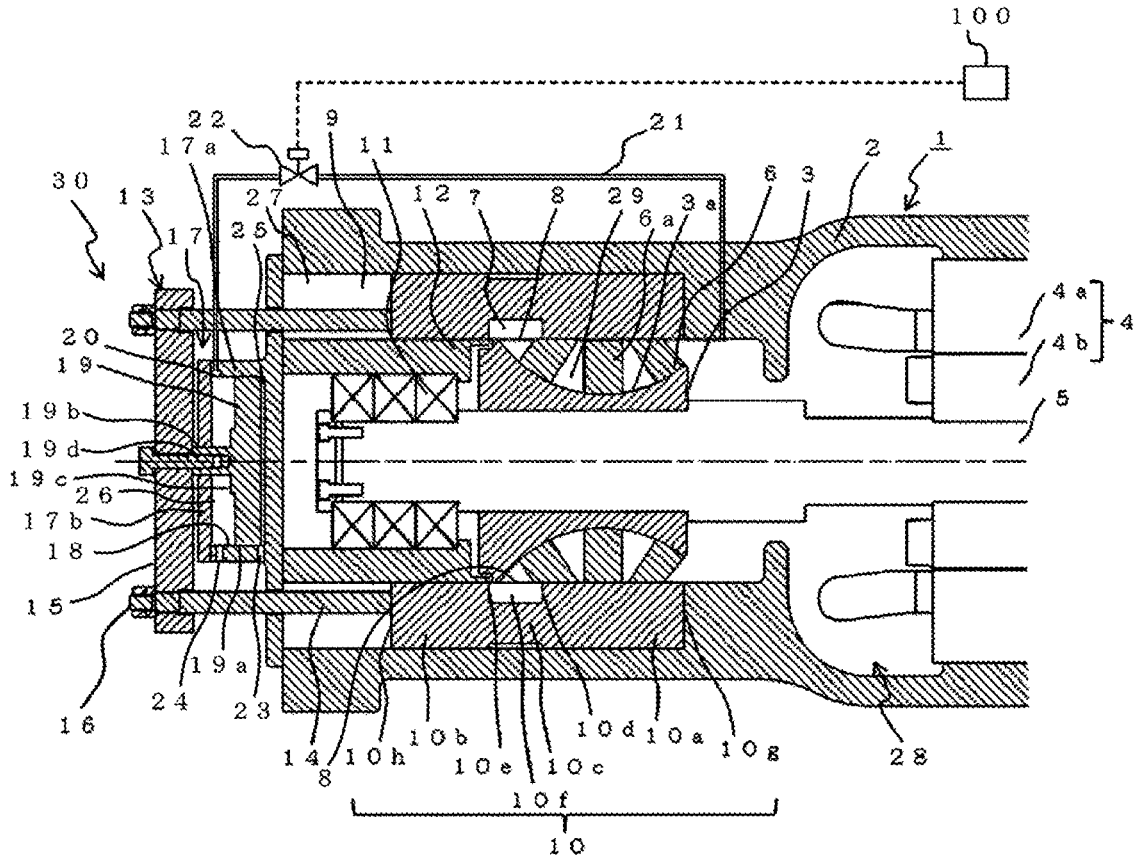
FIG. 2 is a schematic cross-sectional view of the slide valve movement mechanism in the screw compressor according to Embodiment 1 when the piston is moved toward a first chamber.

FIG. 1 is a schematic cross-sectional view of a slide valve movement mechanism in a screw compressor according to Embodiment 1 when a piston is moved toward a second chamber. FIG. 2 is a schematic cross-sectional view of the slide valve movement mechanism in the screw compressor according to Embodiment 1 when the piston is moved toward a first chamber.

A screw compressor 1 according to Embodiment 1 is a single screw compressor and provided in a refrigerant circuit to compress refrigerant. The refrigerant circuit performs a refrigeration cycle. The screw compressor 1, as its schematic configuration is illustrated in FIGS. 1 and 2, has a cylindrical casing body 2, a screw rotor 3 accommodated in the casing body 2, and a motor 4 that rotationally drives the screw rotor 3. The motor 4 has a stator 4*a* that is in contact with the inner surface of the casing body 2 and fixed to the casing body 2, and a motor rotor 4*b* located on the inner side of the stator 4*a*. The rotation frequency of the motor 4 is controlled by an inverter. The screw rotor 3 and the motor rotor 4*b* are located coaxially with each other, and are both fixed to a screw shaft 5.

The screw rotor 3 is cylindrical, and is provided with a plurality of grooves 3*a* that are each shaped in a spiral and are formed at the outer circumferential surface of the screw rotor 3. The screw rotor 3 is connected with the motor rotor 4*b* fixed to the screw shaft 5 and is rotationally driven by the motor 4. The screw shaft 5 is supported by a main bearing 11 and a sub-bearing (not illustrated) such that the screw shaft 5 is rotatable. The main bearing 11 is located in a main-bearing housing 12 provided at the end portion on the discharge-side of the screw rotor 3. The sub-bearing is provided at an end portion of the screw shaft 5 that lies on the suction side of the screw rotor 3.

The grooves 3*a* are formed at the cylindrical surface of the screw rotor 3. A space in the grooves 3*a* is surrounded by an inner cylindrical surface of the casing body 2 and a pair of gate rotors 6 to form a compression chamber 29. The pair of gate rotors 6 has gate-rotor tooth portions 6*a* that mesh with and engage with the grooves 3*a*. The interior of the casing body 2 is partitioned by a partition (not illustrated) into a high-pressure space 27 and a low-pressure space 28. In the high-pressure space 27, a discharge port 8 is formed and opened toward a discharge chamber 7. The high-pressure space 27 is filled with refrigerant gas at a high pressure that is at a discharge pressure and the high-pressure space 27 is thus at a high pressure. The low-pressure space 28 is filled with refrigerant gas at a low pressure that is at a suction pressure and the low-pressure space 28 is thus at a low pressure. At an end portion of the casing body 2 opposite to the motor 4, a shell part (not illustrated) is installed. In the shell part, a high-pressure space 30 is provided. A slide valve movement mechanism 13 is accommodated in this shell part. The slide valve movement mechanism 13 will be described later. Hereinafter, one region near the high-pressure space in the rotational-shaft direction of the screw rotor 3 is sometimes referred to as "discharge side in the shaft direction," while the other region near the low-pressure space 28 in the rotational-shaft direction of the screw rotor 3 is sometimes referred to as "suction side in the shaft direction."

At the inner wall surface of the casing body 2, a slide groove 9 is formed. In the slide groove 9, a slide valve 10 is accommodated and movable along the rotational-shaft direction of the screw rotor 3. The slide valve 10 forms a portion of the discharge port 8. The discharge port 8 is opened, that is, the compression chamber 29 communicates with the discharge chamber 7, at a variable timing depending on the position of the slide valve 10. The discharge port 8 is opened at a variable timing in this manner, so that the internal volume ratio of the screw rotor 3 is regulated. Specifically, as illustrated in FIG. 1, the slide valve 10 is positioned on the discharge side in the shaft direction (on the left side in FIG. 1) to delay the timing at which the discharge port 8 is opened. This increases the internal volume ratio. Also as illustrated in FIG. 2, the slide valve 10 is positioned on the suction side in the shaft direction (on the right side in FIG. 2) to advance the timing at which the discharge port 8 is opened. This decreases the internal volume ratio.

The slide valve 10 has a valve body 10*a*, a guide portion 10*b*, and a connection portion 10*c*. The valve body 10*a* has a suction-side end portion 10*g* and a discharge-port-side end portion 10*d* opposite to the suction-side end portion 10*g*. The guide portion 10*b* has a discharge-port-side end portion 10*e*. The discharge-port-side end portions 10*d* and 10*e* are connected with each other by the connection portion 10*c*, while forming a discharge flow passage 10*f* between them. The discharge flow passage 10*f* communicates with the discharge port 8 described above. The guide portion 10*b* has a discharge-side end portion 10*h* with which a rod 14 is connected.

At an end portion of the screw rotor 3 opposite to the motor 4, the slide valve movement mechanism 13 is located to move the slide valve 10 such that the slide valve 10 slides in the rotational-shaft direction of the screw rotor 3. The slide valve movement mechanism 13 has a hollow cylinder 17 provided in the casing body 2, a piston 19, a connection arm 15 connected with a piston rod 19*d* of the piston 19, and the rod 14. The rod 14 is a part connecting the slide valve 10 and the connection arm 15 with each other. The rod 14, at its end portion on the suction side in the shaft direction, is fixed to the slide valve 10. The rod 14, at its end portion on the discharge side in the shaft direction, is fixed to the connection arm 15 with bolts and nuts 16.

The cylinder 17 is a hollow part extending in the rotational-shaft direction of the screw rotor 3. The cylinder 17 has a cylinder body 17*a* in which the piston 19 moves, and a cylinder lid 17*b* that closes the opening end of the cylinder body 17*a* directed toward the discharge side in the shaft direction. The piston 19 is located inside the cylinder 17 and partitions the interior of the cylinder 17 into a first chamber 25 directed toward the low-pressure space 28, and a second chamber 26 directed toward the high-pressure space 27. The piston 19 moves in the rotational-shaft direction of the screw rotor 3 because of the pressure difference between the first chamber 25 and the second chamber 26. In conjunction with the movement of the piston 19, the slide valve 10 moves.

The cylinder body 17*a* is provided with a first inflow hole 23 passing through a wall of the cylinder body 17*a* and communicating with the first chamber 25. The first inflow hole 23 communicates with the high-pressure space 27. Because of this structure, high-pressure refrigerant gas constantly flows into the first chamber 25 such that the first chamber 25 is maintained at a high pressure.

In addition, the cylinder body 17*a* is provided with a second inflow hole 20 and a third inflow hole 24 passing through the cylinder body 17*a* and communicating with the second chamber 26. The second inflow hole 20 is provided to communicate with the low-pressure space 28 through a communication flow passage 21, which will be described later. The third inflow hole 24, which is the other inflow hole communicating with the second chamber 26, communicates with the high-pressure space 27. As the third inflow hole 24 communicates with the high-pressure space 27, high-pressure refrigerant gas constantly flows into the second chamber 26. As illustrated in FIG. 1, the third inflow hole 24 is located at a position at which the third inflow hole 24 is closed by an outer circumferential surface 19*a* of the piston 19 when the piston 19 moves toward the discharge side in the shaft direction and then a second-chamber-side end face 19*c* of the piston 19 is positioned on the cylinder lid 17*b*. That is, the third inflow hole 24 is located at a position at which the third inflow hole 24 is closed by the piston 19 when the piston 19 lies at the stop position at which the piston 19 moves toward the second chamber 26 and stops.

Between an inner circumferential surface 18 of the cylinder body 17*a* and an outer circumferential surface 19*a* of the piston 19, a very small gap is provided to help the piston 19 move in the cylinder body 17*a*. A piston-rod passage hole is provided at the central portion of the cylinder lid 17*b*. Between an inner circumferential surface 19*b* of the piston-rod passage hole and an outer circumferential surface of the piston rod 19*d*, a very small gap is also provided to help the piston rod 19*d* move through this piston-rod passage hole. A sealing material to seal these very small gaps may be provided to prevent high-pressure refrigerant gas from flowing into the second chamber 26 from the outside of the second chamber 26 through these gaps.

The slide valve movement mechanism 13 further has the communication flow passage 21 and a valve 22. The second chamber 26 communicates with the low-pressure space 28 through the communication flow passage 21. The valve 22 is capable of opening and closing the communication flow passage 21. Specifically, the communication flow passage 21 may be formed by, for example, drilling the casing body 2 and the cylinder 17, or may be, for example, pipes located on the outside of the casing body 2. The valve 22 is a solenoid valve capable of opening and closing the communication flow passage 21, or a flow regulating valve capable of regulating the flow rate of fluid flowing through the communication flow passage 21, such as an expansion valve. The slide valve movement mechanism 13 varies the pressure in the second chamber 26 by opening and closing the valve 22 and thus moves the piston 19 and the slide valve 10.

The screw compressor 1 further has a controller 100 that controls the screw compressor in its entirety. The controller 100 exercises an opening and closing control on the valve 22, a rotation frequency control on the motor 4, and other controls.

Figure 3:
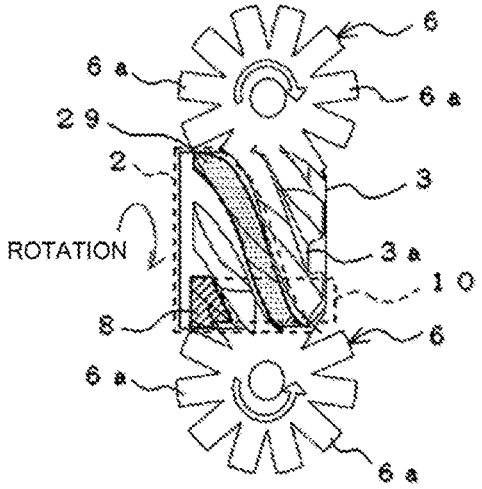
FIG. 3 is an explanatory view illustrating a sucking process that is operation of a compression portion of the screw compressor according to Embodiment 1.
Figure 4:
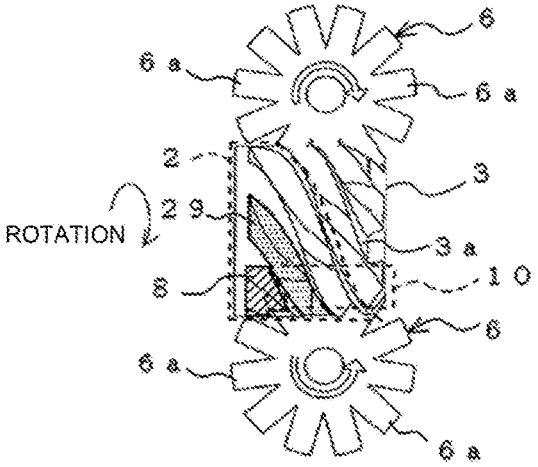
FIG. 4 is an explanatory view illustrating a compressing process that is operation of the compression portion of the screw compressor according to Embodiment 1.
Figure 5:
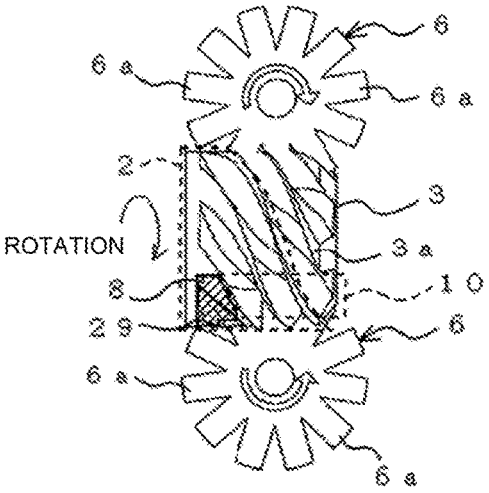
FIG. 5 is an explanatory view illustrating a discharging process that is operation of the compression portion of the screw compressor according to Embodiment 1.

Next, with reference to FIGS. 3 to 5, operation of the screw compressor 1 according to the present Embodiment 1 is described. FIG. 3 is an explanatory view illustrating a sucking process that is operation of a compression portion of the screw compressor according to Embodiment 1. FIG. 4 is an explanatory view illustrating a compressing process that is operation of the compression portion of the screw compressor according to Embodiment 1. FIG. 5 is an explanatory view illustrating a discharging process that is operation of the compression portion of the screw compressor according to Embodiment 1. Note that the respective processes are described below with a focus on the compression chamber 29 illustrated by dotted hatching in FIGS. 3 to 5.

As illustrated in FIGS. 3 to 5, in the screw compressor 1, the screw rotor 3 is rotated through the use of the screw shaft 5 by the motor 4, so that the gate-rotor tooth portions 6*a* of the gate rotors 6 move relatively in the compression chamber 29. With this movement, in the compression chamber 29, the sucking process (FIG. 3), the compressing process (FIG. 4), and the discharging process (FIG. 5) are considered as one cycle, and this cycle is repeated.

FIG. 3 illustrates the state of the compression chamber 29 in the sucking process. In the state illustrated in FIG. 3, when the screw rotor 3 is driven by the motor 4 and rotated in a direction shown by the solid arrow, the volume of the compression chamber 29 is decreased as illustrated in FIG. 4. When the screw rotor 3 is continuously rotated, the compression chamber 29 communicates with the discharge port 8 as illustrated in FIG. 5. The compression chamber 29 communicates with the discharge port 8, so that high-pressure refrigerant gas compressed in the compression chamber 29 is discharged from the discharge port 8 to the discharge chamber 7. Refrigerant gas is compressed again on the back side of the screw rotor 3 in the same manner as described above.

Next, operation of the slide valve movement mechanism 13 is described.

(i) Operation to Move the Piston 19 Toward the Second Chamber 26 (Leftward In FIG. 1)

When the piston 19 is moved toward the second chamber 26, the controller 100 causes the valve 22 to be opened. When the valve 22 is opened, the second chamber 26 of the cylinder 17 communicates with the low-pressure space 28 through the communication flow passage 21, and is thus at a low pressure. As the first chamber 25 of the cylinder 17 communicates with the high-pressure space 27 through the first inflow hole 23, high-pressure refrigerant gas constantly flows into the first chamber 25, so that the first chamber 25 is at a high pressure. Therefore, the pressure difference between the first chamber 25 and the second chamber 26 causes the piston 19 to move toward the second chamber 26.

Meanwhile, the slide valve 10 connected with the piston 19 is applied with pressures described below. That is, the suction-side end portion 10*g* of the valve body 10*a* is applied with a low pressure, while the discharge-side end portion 10*h* of the guide portion 10*b* is applied with a high pressure. The discharge-port-side end portion 10*d* of the valve body 10*a* is applied with a high pressure. The discharge-port-side end portion 10*e* of the guide portion 10*b* is applied with a pressure equal to the pressure applied to the discharge-port-side end portion 10*d* of the valve body 10*a*. These equal pressures are applied in directions opposite to each other. Therefore, in the slide valve 10, a load applied to the discharge-port-side end portion 10*e*, and a load applied to the discharge-port-side end portion 10*d* cancel each other out. The pressures applied to the slide valve 10 as described above cause the slide valve 10 to move toward the first chamber 25 (rightward in FIG. 1) by the difference between the pressure applied to the discharge-side end portion 10*h* and the pressure applied to the suction-side end portion 10*g*.

The piston 19 has a pressure receiving area that is set larger than the pressure receiving area of the discharge-side end portion 10*h* applied with a high pressure. Because of this structure, the difference between the pressures received by the respective pressure receiving areas causes the piston 19 and the slide valve 10 to move toward the second chamber 26. The piston 19 stops at a position where the second-chamber-side end face 19*c* is positioned on the cylinder lid 17*b*.

The piston 19 moves toward the second chamber 26 in the manner as described above, so that the slide valve 10 also moves toward the second chamber 26, in other words, toward the discharge side in the shaft direction in conjunction with the piston 19. This movement delays the timing at which the discharge port 8 is opened, as described above. Consequently, the internal volume ratio is increased. Therefore, under the operating condition with a relatively large difference between pressure levels in the refrigerant circuit to which the screw compressor 1 is applied, the controller 100 causes the valve 22 to be opened to increase the internal volume ratio. This prevents refrigerant gas from being insufficiently compressed.

In some structure, even after the valve is opened and the second chamber is thus caused to communicate with the low-pressure space, the second chamber still remains communicating with the high-pressure space through the inflow hole. Thus, high-pressure refrigerant gas is constantly introduced into the second chamber. Therefore, the refrigerant gas introduced into the second chamber flows out to the low-pressure space through the valve. This results in performance degradation.

In contrast to this structure, in the structure of the present Embodiment 1, the valve 22 is opened and the second chamber 26 is thus caused to communicate with the low-pressure space 28, and thereafter the third inflow hole 24 is closed by the piston 19 to prevent the second chamber 26 from communicating with the high-pressure space 27. Because of this structure, high-pressure refrigerant gas is less likely to flow into the second chamber 26 through the third inflow hole 24. Consequently, the high-pressure refrigerant gas having flowed into the second chamber 26 through the third inflow hole 24 is less likely to flow out to the low-pressure space 28. This achieves reduced performance degradation.

(ii) Operation to Move the Piston 19 Toward the First Chamber 25 (Rightward In FIG. 2)

When the piston 19 is moved toward the first chamber 25, the controller 100 causes the valve 22 to be closed. Immediately after the valve 22 is closed, the third inflow hole 24 communicating with the second chamber 26 is closed by the outer circumferential surface 19*a* of the piston 19. Thus, high-pressure refrigerant gas is not easily introduced into the second chamber 26. However, even when the third inflow hole 24 is closed, high-pressure refrigerant gas still flows into the second chamber 26 through the very small gaps located around the periphery of the second chamber 26, so that the pressure in the second chamber 26 increases and then the piston 19 moves toward the first chamber 25.

The very small gaps located around the periphery of the second chamber 26 are the very small gap provided between the inner circumferential surface 18 of the cylinder body 17*a* and the outer circumferential surface 19*a* of the piston 19, and the very small gap provided between the outer circumferential surface of the piston rod 19*d* of the piston 19 and the inner circumferential surface 19*b* of the cylinder lid 17*b*. Note that as described above, a sealing material may be provided to the gap between the inner circumferential surface 18 of the cylinder body 17*a* and the outer circumferential surface 19*a* of the piston 19. When a sealing material is provided to this gap, the sealing material is located such that the sealing material does not overlap the third inflow hole 24. Even when the sealing material is located, high-pressure refrigerant gas is thus still allowed to flow into the second chamber 26 through the gap between the outer circumferential surface 19*a* and the third inflow hole 24.

As the piston 19 moves toward the first chamber 25, the third inflow hole 24 is gradually opened, and thus high-pressure refrigerant gas easily flows into the second chamber 26 through the third inflow hole 24. When high-pressure refrigerant gas flows into the second chamber 26 through the third inflow hole 24, the pressure in the second chamber 26 is increased to a high level, so that there is no pressure difference between the first chamber 25 and the second chamber 26 in the cylinder 17.

Meanwhile, of the slide valve 10 connected with the piston 19, the suction-side end portion 10*g* of the valve body 10*a* is applied with a low pressure, while the discharge-side end portion 10*h* of the guide portion 10*b* is applied with a high pressure. The discharge-port-side end portion 10*d* of the valve body 10*a* is applied with a high pressure. The discharge-port-side end portion 10*e* of the guide portion 10*b* is applied with a pressure equal to the pressure applied to the discharge-port-side end portion 10*d*. These equal pressures are applied in directions opposite to each other. Therefore, in the slide valve 10, a load applied to the discharge-port-side end portion 10*e*, and a load applied to the discharge-port-side end portion 10*d* cancel each other out. The pressures applied to the slide valve 10 as described above cause the slide valve 10 and the piston 19 to move toward the first chamber 25 because of the differential pressure between a high pressure applied to the discharge-side end portion 10*h* and a low pressure applied to the suction-side end portion 10*g*. Then, the slide valve 10 and the piston 19 both stop at the position at which the suction-side end portion 10*g* of the piston is positioned on the casing body 2.

The piston 19 is moved toward the first chamber 25 in the manner as described above, so that the slide valve 10 also moves toward the first chamber 25, in other words, toward the suction side in the shaft direction in conjunction with the piston 19. This movement advances the timing at which the discharge port 8 is opened, as described above. Consequently, the internal volume ratio is decreased. Therefore, under the operating condition with a relatively small difference between pressure levels in the refrigerant circuit to which the screw compressor 1 is applied, the controller 100 causes the valve 22 to be closed to decrease the internal volume ratio. This prevents refrigerant gas from being excessively compressed.

The screw compressor 1 of the present Embodiment 1 has the casing body 2 that has, inside the casing body 2, the high-pressure space 27 and the low-pressure space 28, the screw rotor 3 that has the plurality of grooves 3*a* that are each shaped in a spiral and are formed at the outer circumferential surface of the screw rotor 3, the screw rotor 3 being rotationally driven, and the gate rotors 6, each of which has a plurality of gate-rotor tooth portions 6*a* to mesh with the plurality of grooves 3*a* of the screw rotor 3, the gate rotors 6 defining the compression chamber 29 together with the casing and the screw rotor 3. The screw compressor 1 further has the slide valve 10 accommodated in the slide groove 9 formed in an inner wall surface of the casing, the slide valve 10 being configured to move such that the slide valve 10 slides in a rotational-shaft direction of the screw rotor 3, and the slide valve movement mechanism 13 configured to move the slide valve 10 such that the slide valve 10 slides in the rotational-shaft direction of the screw rotor 3. The slide valve movement mechanism 13 has the cylinder 17 provided in the casing body 2, the cylinder 17 being hollow, the piston 19 connected with the slide valve 10, the piston 19 partitioning the interior of the cylinder 17 into the first chamber 25 and the second chamber 26, the communication flow passage 21 through which the second chamber 26 communicates with the low-pressure space 28, and the valve 22 configured to open and close the communication flow passage 21. The slide valve movement mechanism 13 varies the pressure in the second chamber 26 by opening and closing the valve 22 and thus moves the piston 19 and the slide valve 10. The cylinder 17 is provided with the first inflow hole 23, the second inflow hole 20, and the third inflow hole 24. The first chamber 25 communicates with the high-pressure space 27 through the first inflow hole 23. The second chamber 26 communicates with the low-pressure space 28 through the second inflow hole 20 and the communication flow passage 21. The second chamber 26 communicates with the high-pressure space 27 through the third inflow hole 24. The third inflow hole 24 is located at a position at which the third inflow hole 24 is closed by the piston 19 when the piston 19 lies at the stop position at which the piston 19 moves toward the second chamber 26 and stops.

Due to this structure, the third inflow hole 24 is closed by the piston 19 when the piston 19 lies at the stop position at which the piston 19 moves toward the second chamber 26 and stops. This configuration stops high-pressure refrigerant gas from flowing into the second chamber 26 through the third inflow hole 24, and thus achieves reduced leakage of refrigerant gas from the second chamber 26 toward the low-pressure space 28. That is, this configuration achieves reduced leakage of refrigerant gas from the third inflow hole 24 that is an inflow hole through which high-pressure refrigerant gas flows into the second chamber 26. In this configuration, the third inflow hole 24 is only closed by the piston 19, so that the screw compressor 1 with high efficiency is obtained by a low-cost method.

The cylinder 17 has the cylinder body 17*a* in which the piston 19 moves, and the cylinder lid 17*b* that closes the opening of the cylinder body 17*a* that is one end close to the second chamber 26 in a direction in which the piston 19 moves. The third inflow hole 24 is located at the cylinder body 17*a*.

As described above, in a case where the third inflow hole 24 is located at the cylinder body 17*a*, the third inflow hole 24 is closed by the outer circumferential surface 19*a* of the piston 19.

The valve 22 is an opening-closing valve or a flow regulating valve.

As described above, the valve 22 is an opening-closing valve or a flow regulating valve.

Embodiment 2

Next, Embodiment 2 is described. Embodiment 1 illustrates the configuration in which the third inflow hole 24 is located at the cylinder body 17*a*, and high pressure is introduced into the second chamber 26 through the third inflow hole 24. In contrast to this configuration, Embodiment 2 has a configuration in which the third inflow hole 24 is located at the cylinder lid 17*b*. Except for the difference, the configuration is identical to that in Embodiment 1. Hereinafter, the configuration in Embodiment 2 that is different from that in Embodiment 1 is mainly described. The configuration that is identical to that in Embodiment 1 is not described in Embodiment 2.

Figure 6:
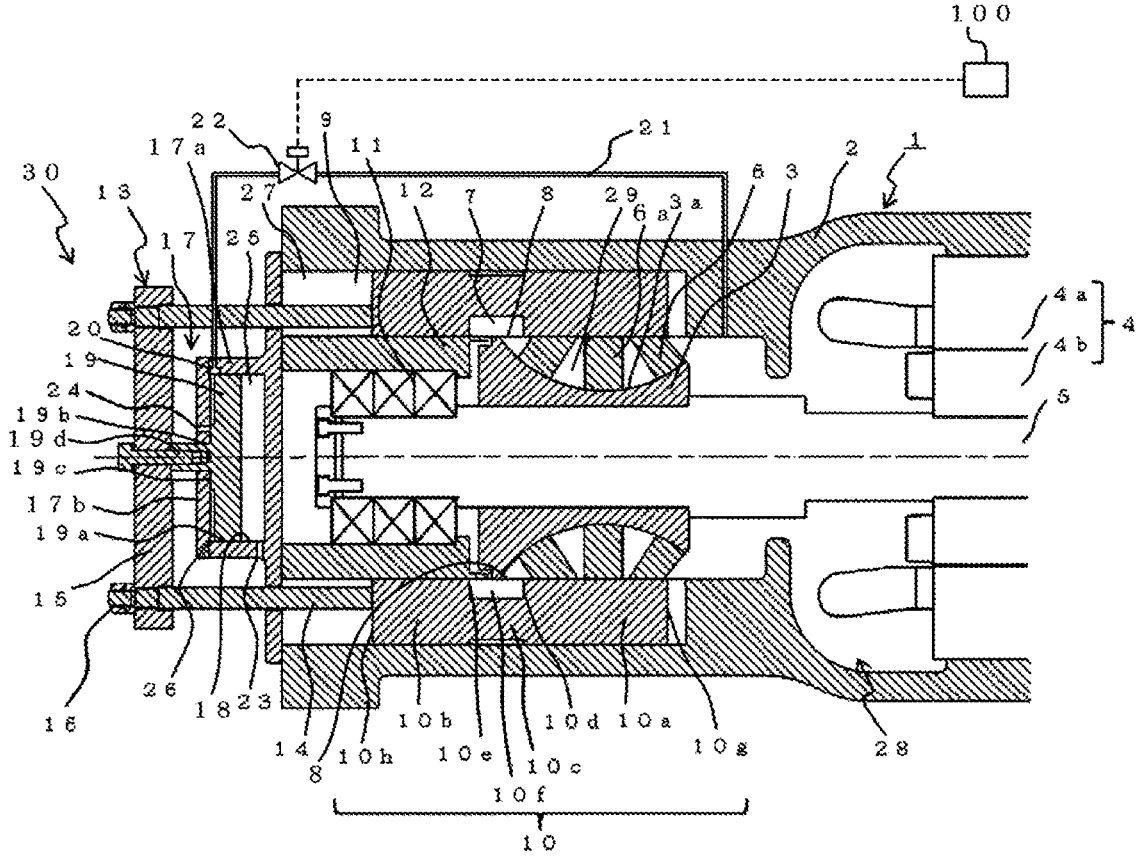
FIG. 6 is a schematic cross-sectional view of a slide valve movement mechanism in a screw compressor according to Embodiment 2 when a piston is moved toward a second chamber.
Figure 7:
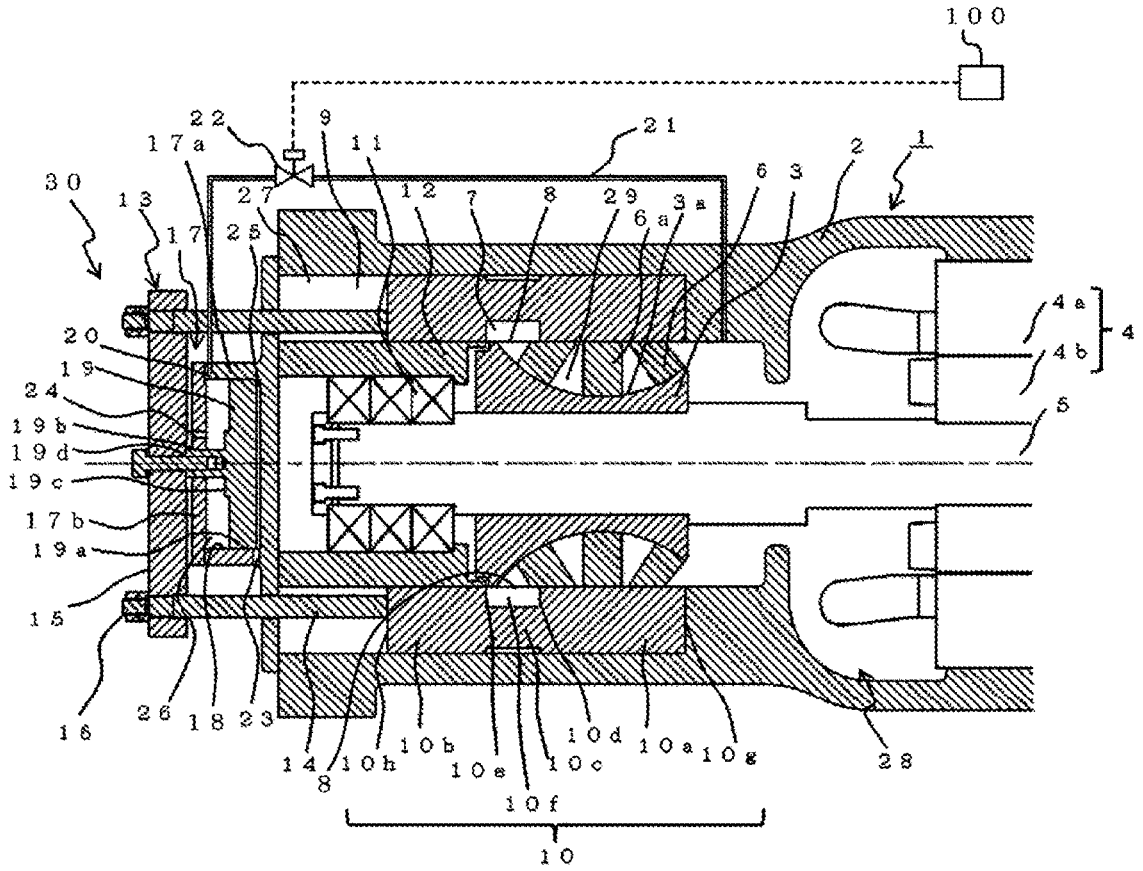
FIG. 7 is a schematic cross-sectional view of the slide valve movement mechanism in the screw compressor according to Embodiment 2 when the piston is moved toward a first chamber.

FIG. 6 is a schematic cross-sectional view of a slide valve movement mechanism in a screw compressor according to Embodiment 2 when a piston is moved toward the second chamber 26. FIG. 7 is a schematic cross-sectional view of the slide valve movement mechanism in the screw compressor according to Embodiment 2 when the piston is moved toward the first chamber 25.

The screw compressor 1 in Embodiment 2 is different in the position of the third inflow hole 24 from Embodiment 1. The third inflow hole 24, through which high pressure is introduced into the second chamber 26, is located at the cylinder lid 17*b*. Specifically, as illustrated in FIG. 7, the third inflow hole 24 is located at a position at which the third inflow hole 24 is closed by the second-chamber-side end face 19*c* of the piston 19 when the piston 19 moves toward the second chamber 26 and then the second-chamber-side end face 19*c* is positioned on the cylinder lid 17*b*.

According to the present Embodiment 2, the third inflow hole 24 is closed by positioning the second-chamber-side end face 19*c* of the piston 19 on the cylinder lid 17*b*. In Embodiment 1 described above, there is a gap between the third inflow hole 24 and the outer circumferential surface 19*a* of the piston 19. In the present Embodiment 2, the third inflow hole 24 is closed by positioning the piston 19 on the cylinder lid 17*b*, so that the size of the gap is reduced compared to Embodiment 1. With this structure, the present Embodiment 2 achieves the reduced volume of high-pressure refrigerant gas that flows into the second chamber 26 through the third inflow hole 24, compared to Embodiment 1. That is, compared to Embodiment 1, the present Embodiment 2 achieves the reduced volume of high-pressure refrigerant gas that flows out of the second chamber 26 toward the low-pressure space 28, and thus obtains the screw compressor 1 with higher efficiency.

In a state in which the second-chamber-side end face 19*c* of the piston 19 is positioned on the cylinder lid 17*b*, the second-chamber-side end face 19*c* of the piston 19 receives a high pressure from the third inflow hole 24 in a direction corresponding with the direction in which the piston 19 is moved toward the first chamber 25. This helps the piston 19 move toward the first chamber 25 more easily when the valve 22 is closed in the present Embodiment 2, compared to Embodiment 1. In Embodiment 1, the third inflow hole 24 is brought into an opened state for the first time after the piston 19 moves by some distance from the position where the piston 19 is positioned on the cylinder lid 17*b*. In contrast to this structure, in Embodiment 2, simultaneously with the movement of the piston 19 away from the cylinder lid 17*b*, the third inflow hole 24 is opened and high pressure thus starts to be introduced into the second chamber 26. Also in this regard, Embodiment 2 is thought to be a structure that helps the piston 19 move toward the first chamber 25 more easily compared to Embodiment 1.

As explained above, the screw compressor 1 in the present Embodiment 2 obtains the following effects in addition to the effects that are the same as those obtained by Embodiment 1. That is, the cylinder 17 of the screw compressor 1 in the present Embodiment 2 has the cylinder lid 17*b* that closes the opening of the cylinder body 17*a* that is one end close to the second chamber 26 in the direction in which the piston 19 moves, and the third inflow hole 24 is located at the cylinder lid 17*b*. This helps the piston 19 move toward the first chamber 25 more easily, so that the screw compressor 1 is obtained, which is more responsive to the change in the internal volume ratio because of opening and closing of the valve 22.

REFERENCE SIGNS LIST

1: screw compressor, 2: casing body, 3: screw rotor, 3*a*: groove, 4: motor, 4*a*: stator, 4*b*: motor rotor, 5: screw shaft, 6: gate rotor, 6*a*: gate-rotor tooth portion, 7: discharge chamber, 8: discharge port, 9: slide groove, 10: slide valve, 10*a*: valve body, 10*b*: guide portion, 10*c*: connection portion, 10*d*: discharge-port-side end portion, 10*e*: discharge-port-side end portion, 10*f*: discharge flow passage, 10*g*: suction-side end portion, 10*h*: discharge-side end portion, 11: main bearing, 12: main-bearing housing, 13: slide valve movement mechanism, 14: rod, 15: connection arm, 16: nut, 17: cylinder, 17*a*: cylinder body, 17*b*: cylinder lid, 18: inner circumferential surface, 19: piston, 19*a*: outer circumferential surface, 19*b*: inner circumferential surface, 19*c*: second-chamber-side end face, 19*d*: piston rod, 20: second inflow hole, 21: communication flow passage, 22: valve, 23: first inflow hole, 24: third inflow hole, 25: first chamber, 26: second chamber, 27: high-pressure space, 28: low-pressure space, 29: compression chamber, 30: high-pressure space, 100: controller

The invention claimed is:

1. A screw compressor comprising:

a casing body that has, inside the casing body, a high-pressure space and a low-pressure space;

a screw rotor that has a plurality of grooves that are each shaped in a spiral and are formed at an outer circumferential surface of the screw rotor, the screw rotor being rotationally driven;

gate rotors, each of which has a plurality of gate-rotor tooth portions to mesh with the plurality of grooves of the screw rotor, the gate rotors defining a compression chamber together with the casing body and the screw rotor;

a slide valve accommodated in a slide groove formed in an inner wall surface of the casing body, the slide valve being configured to move such that the slide valve slides in a rotational-shaft direction of the screw rotor, and the slide valve forming a portion of a discharge port from which fluid that is compressed in the compression chamber is discharged to a discharge chamber, the discharge port configured to open at a timing dependent upon a position of the slide valve in the rotational-shaft direction of the screw rotor; and a slide valve movement mechanism configured to move the slide valve such that the slide valve slides in the rotational-shaft direction of the screw rotor, the slide valve movement mechanism having a cylinder provided in the casing body, the cylinder being hollow, a piston connected with the slide valve, the piston partitioning an interior of the cylinder into a first chamber and a second chamber, a communication flow passage through which the second chamber communicates with the low-pressure space, and a valve configured to open and close the communication flow passage, the slide valve movement mechanism being configured to vary a pressure in the second chamber by opening and closing the valve and thus move the piston and the slide valve, the cylinder being provided with a first inflow hole, a second inflow hole, and a third inflow hole, the first chamber communicating with the high-pressure space through the first inflow hole, the second chamber communicating with the low-pressure space through the second inflow hole and the communication flow passage, the second chamber communicating with the high-pressure space through the third inflow hole, the cylinder having a cylinder body in which the piston moves, the first inflow hole passing through the cylinder body, and the third inflow hole being located at a position at which the third inflow hole is closed by the piston when the piston lies at a stop position at which the piston moves toward the second chamber and stops.

2. The screw compressor of claim 1, wherein the cylinder has a cylinder lid that closes an opening of the cylinder body that is one end close to the second chamber in a direction in which the piston moves, and the third inflow hole is located at the cylinder body.

3. The screw compressor of claim 1, wherein the cylinder has a cylinder lid that closes an opening of the cylinder body that is one end close to the second chamber in a direction in which the piston moves, and the third inflow hole is located at the cylinder lid.

4. The screw compressor of claim 1, wherein the valve comprises an opening-closing valve or a flow regulating valve.

* * * * *